US006264493B1

(12) United States Patent
Loibl et al.

(10) Patent No.: US 6,264,493 B1
(45) Date of Patent: Jul. 24, 2001

(54) ELECTRICAL PLUG CONNECTION BETWEEN A KNIFE-EDGE CONTACT AND THE CONTACT END OF A CONNECTOR

(75) Inventors: Josef Loibl, Regen; Ulf Scheuerer, Regensburg, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/048,564

(22) Filed: Mar. 26, 1998

(30) Foreign Application Priority Data

Mar. 26, 1997 (DE) ..... 197 12 846

(51) Int. Cl.[7] ..... H01R 4/24
(52) U.S. Cl. ..... 439/404; 335/278
(58) Field of Search ..... 439/443, 404, 439/417, 357

(56) References Cited

U.S. PATENT DOCUMENTS

| | | | | |
|---|---|---|---|---|
| 3,609,643 | | 9/1971 | Connan . | |
| 4,671,596 | | 6/1987 | Soma . | |
| 4,682,840 | * | 7/1987 | Lockard | 439/874 |
| 4,778,407 | * | 10/1988 | Myers | 439/443 |
| 4,820,190 | | 4/1989 | Humphrey . | |
| 5,037,329 | | 8/1991 | Wright . | |
| 5,295,857 | * | 3/1994 | Toly | 439/395 |
| 5,725,290 | * | 3/1998 | Thomas et al. | 303/119.2 |
| 5,749,746 | * | 5/1998 | Tan et al. | 439/357 |

FOREIGN PATENT DOCUMENTS

| | | | | |
|---|---|---|---|---|
| 43 44 584 A1 | | 6/1995 | (DE) . | |
| 4344584C2 | | 12/1996 | (DE) . | |
| 4305544C2 | | 8/1997 | (DE) . | |
| 0 039 978 A1 | | 11/1981 | (EP) . | |
| 0 077 610 A2 | | 4/1983 | (EP) . | |
| 066 615 A2 | * | 3/1995 | (EP) | 439/736 |
| 0 691 707 A1 | | 1/1996 | (EP) . | |
| 0 734 095 A1 | | 9/1996 | (EP) . | |

* cited by examiner

*Primary Examiner*—Renee Luebke
*Assistant Examiner*—Briggitte R. Hammond
(74) *Attorney, Agent, or Firm*—Herbert L. Lerner; Laurence A. Greenberg; Werner H. Stemer

(57) ABSTRACT

An electrical plug connection between a knife-edge contact and a contact end of a conductor. The contact end is oriented perpendicularly to a plane defined by the contacts of the knife-edge contact. The contact end is embedded in a plastic bush, which has an insertion opening into which the knife-edge contact is inserted.

6 Claims, 3 Drawing Sheets

10
11
12

21
20
24
23

10
11
12
21
20
22

22
12
23
20
10

ELECTRICAL PLUG CONNECTION BETWEEN A KNIFE-EDGE CONTACT AND THE CONTACT END OF A CONNECTOR

BACKGROUND OF THE INVENTION

FIELD OF THE INVENTION

The invention relates to electrical connectors. More specifically, the invention relates to an electrical plug connection between a knife-edge contact and the contact end of a conductor, in particular for closing an electrical connection in an automatic transmission of a motor vehicle.

Knife-edge contacts are known in fuse boxes of motor vehicles. The knife-edge contact is sheathed by a plastic bush in such a way that the flexible properties of its contacts are preserved. A plain plug contact is inserted into the plastic bush in the direction of the planes defined by the contacts of the knife-edge contact and is guided by the plastic bush. Because the knife-edge contact must be supported flexibly and because the plug contact has to be threaded in, this type of plug connection is only conditionally suited to rational production.

An easily produced plug connection has become known from German Patent DE 43 44 584 C2. Magnet valves for controlling an automatic transmission for a motor vehicle are accommodated in a control housing. The terminal contacts between the magnet valves and the electric lines leading to an electronic control unit must be capable of meeting stringent demands. A secure electrical connection in oil must be assured, despite the vibrations and temperature changes that occur. To that end, it is provided that the magnet valves each have two hooplike, resilient knife contacts that engage in openings of terminal contacts in a prestressed manner.

The press-fitted contact between the knife contacts and the terminal contacts comes about only if the magnet valves are positioned and fixed exactly. Moreover, the contact forces can lessen with age. Because of the necessity of openings in the terminal contacts, either stamped metal sheets or wire lines provided with additional plugs must be used as the electrical lines. Moreover, the contact region is not fully shielded from the outside, and so only limited protection against short circuits that are caused by metal chips in the transmission oil is achieved.

U.S. Pat. No. 4,820,190 to Humphrey discloses an electrical component mounting and connection assembly for a direct connection with a conductor. The contact end of the conductor is oriented vertically to the plane defined by a knife-edge contact. A base part has an insertion opening for introducing the knife-edge contact.

SUMMARY OF THE INVENTION

It is accordingly an object of the invention to provide an electrical plug connection between a knife-edge contact and a conductor, which overcomes the above-mentioned disadvantages of the prior art devices and methods of this general type and which furnishes a reliable, economical electrical plug connection that is simple to produce.

With the foregoing and other objects in view there is provided, in accordance with the invention, an electrical plug connector assembly, comprising:

- a knife-edge contact with knife contacts defining a plane;
- a plastic bush having an insertion opening formed therein adapted to receive the knife contacts of the knife-edge contact;

- a conductor with a contact end oriented perpendicularly to the plane defined by the knife contacts of the knife-edge contact, the contact end being embedded in the plastic bush, extending into the insertion opening, and being free of plastic sheathing in the insertion opening.

In accordance with an added feature of the invention, the contact end is sheathed with plastic in a zone upstream of the insertion opening and in a zone downstream of the insertion opening.

In accordance with another feature of the invention, the contact end is integrally formed with the conductor.

In a preferred embodiment, there is provided, in accordance with the invention, in combination with a magnet valve of a motor vehicle transmission and an electronic control unit, an electrical plug connection which connects the magnet valve to the electronic control unit. The connection assembly comprises:

- a contact carrier formed onto the magnet valve, and a knife-edge contact supported by the contact carrier, the knife-edge contact having knife contacts defining a plane;
- a plastic bush having an insertion opening formed therein adapted to receive the knife contacts of the knife-edge contact;
- a conductor leading from the plastic bush to the electronic control unit, the conductor having a contact end oriented perpendicularly to the plane defined by the knife contacts, the contact end being embedded in the plastic bush, extending into the insertion opening, and being free of plastic sheathing in the insertion opening.

In accordance with an additional feature of the invention, the contact carrier covers the insertion opening of the plastic bush.

In accordance with a concomitant feature of the invention, the contact end of the conductor extends parallel to or coplanar with a plane of the conductor.

If the knife-edge contact comes into contact with the knife-edge plug contact at some arbitrary point thereon, it suffices for a reliable contact between the knife-edge contact and the contact end of a conductor or knife-edge plug contact. The demands for precision in the fastening of the knife-edge plug contact are therefore not very stringent in the plug-in direction. This is highly advantageous, for instance, when magnet valves with knife-edge contacts are inserted into the control housing of an automatic transmission. Most particular, contact forces cannot lessen as the material ages. As a result, it is possible to dispense with costly stamped grid material with elastic properties in the contact region.

Because of the fact that the knife-edge contact is movable while the counterpart contact is rigid, guidance for the knife-edge contact and shielding of the contact region can be achieved especially simply and reliably. Any special additional covering is superfluous because the assembly provides for the necessary shielding of the contacts.

Other features which are considered as characteristic for the invention are set forth in the appended claims.

Although the invention is illustrated and described herein as embodied in an electrical plug connection between a knife-edge contact and the contact end of a conductor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figures 1, 2, 3, 4:
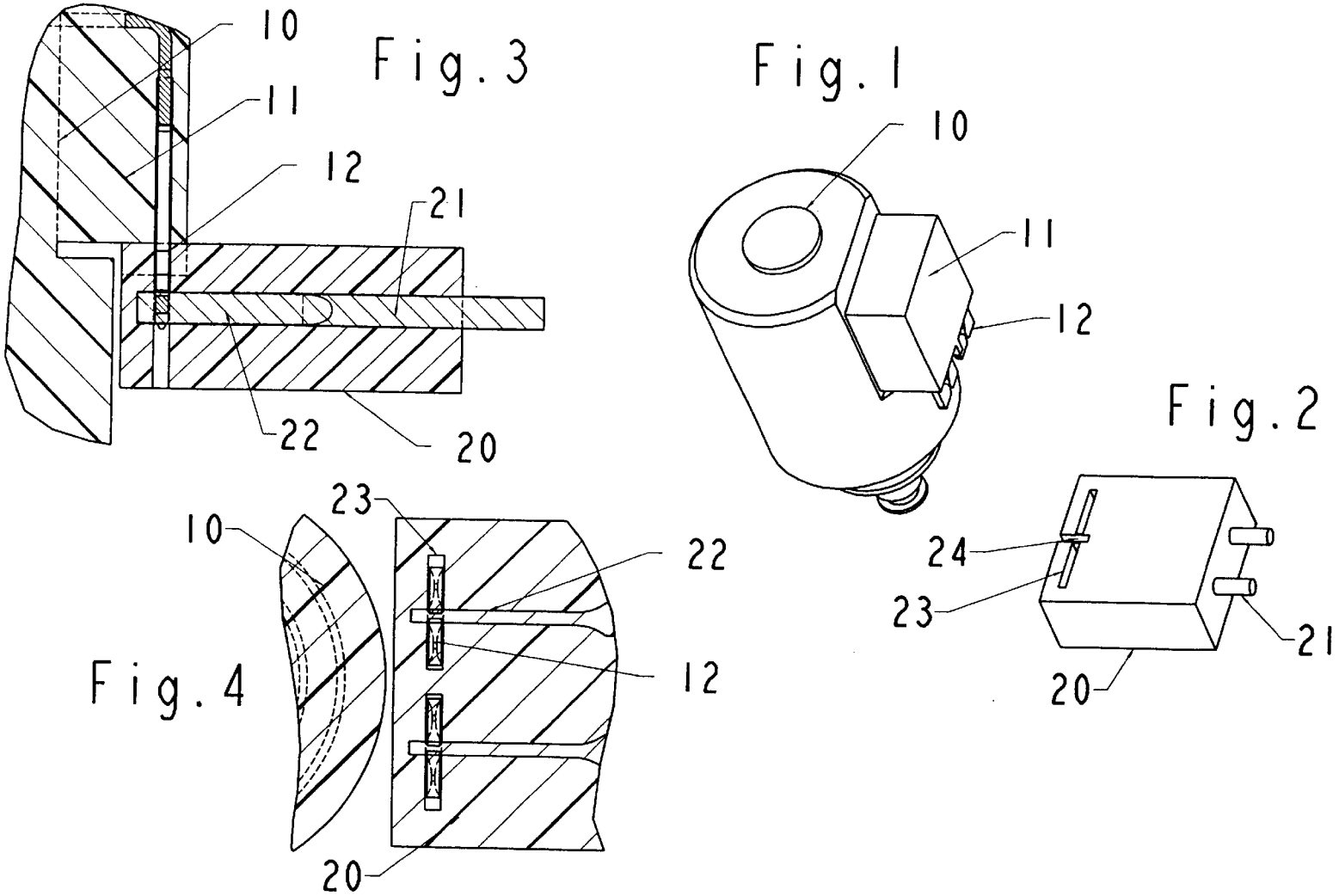
FIG. 1 is a perspective view of a magnet valve.
FIG. 2 is a perspective view of a plastic bush with an insertion opening.
FIG. 3 is a partial vertical sectional view taken through the magnet valve and the plastic bush.
FIG. 4 is a horizontal section taken through the magnet valve and the plastic bush of FIG. 3.

Referring now to the figures of the drawing in detail and first, particularly, to FIG. 1 thereof, there is seen a magnet valve 10 before it is inserted into the control housing of an automatic transmission. A box-shaped contact carrier 11 of plastic is injection-formed onto the magnet valve. The contact carrier sheathes two knife-edge contacts 12, except for their contact region, and fixes them in that way.

Referring now to FIG. 2, the plastic bush 20 has an insertion opening 23, which is adapted to receive the knife-edge contacts 12. Together with the slot-shaped insertion opening 23, a dividing rib 24 countersunk into the plastic bush provides for the guidance of the two knife-edge contacts 12 shown in FIG. 1. Electrical conductors 21 in the form of wires lead to a non-illustrated electronic control unit, either directly or through a plug connection.

Referring now to FIG. 3, there is shown a knife-edge contact 12 that has been introduced into the insertion opening 23 of the plastic bush 20. Only a fragment of the magnet valve 10 is shown.

The contact carrier 11 rests on a plastic bush that is part of a carrier body. Such a carrier body, in an automatic transmission, rests on a lower part of the control housing and holds electrical conductors, sensors, and a plug connection. The contact carrier 11 covers the insertion opening 23 of the plastic bush like a hood. The carrier body rests on a lower part of the control housing. The knife-edge contacts 12 of the magnet valve 10 protrude into an opening in the plastic bush 20 and are slipped over the wires 21. In the region of the contact point, the wires are free of plastic sheathing along their entire circumference.

FIG. 4 shows how the knife-edge contacts 12 contact flat-swaged knife-edge plug contacts 22 after the magnet valve 10 has been fastened in the control housing. Because the contact end of the conductor is received in the terminal contact of the magnet valve, the passive contact end of the conductor can be embedded rigidly in a plastic sheath. For the active, elastic terminal contacts of the magnet valve, which must embrace the rigid contact ends of the line, it is possible by simple means to make an insertion opening 23 in the plastic bush. This opening can serve both to guide the knife-edge contact and to guard against transmission chips (metal chips which, upon accumulation, may cause shorts).

When the knife-edge contact 12 is pressed into the insertion opening 23, the wire 21 spreads apart the elastic hoop of the tong-like knife-edge contact. Durable contacting is assured in particular if the wire 21 is a ribbon wire in the terminal region, as suggested in the drawing.

Figure 5:
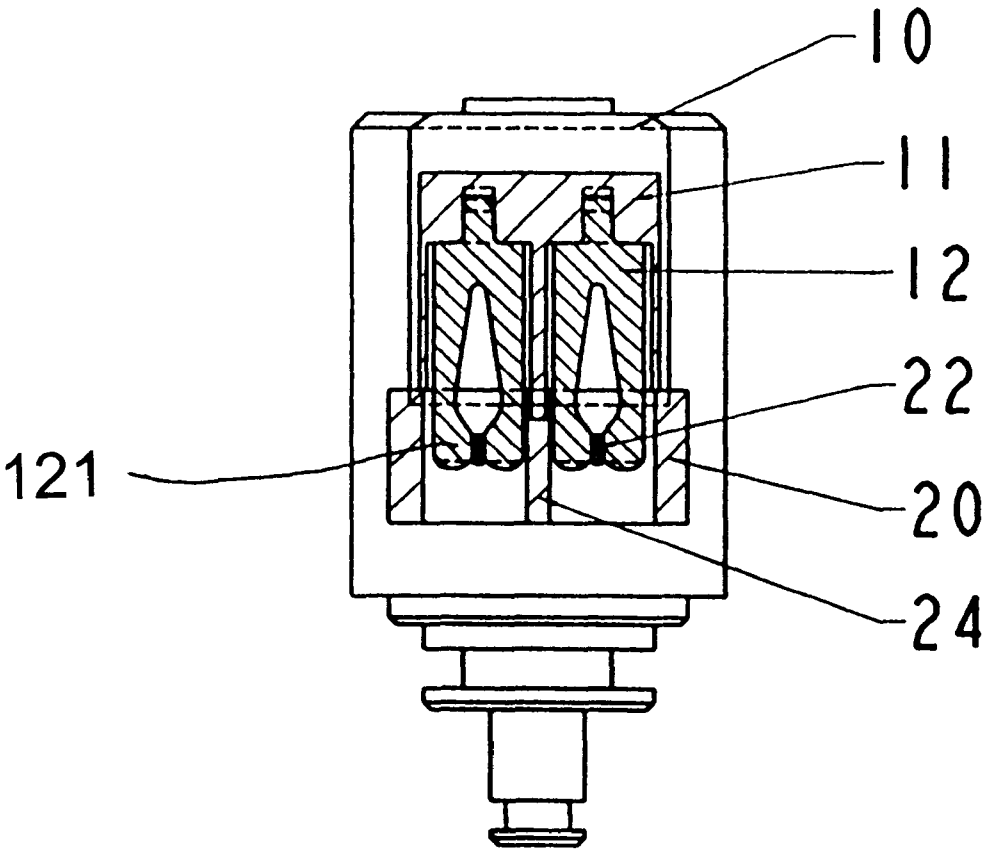
FIG. 5 is a partly sectional view through a magnet valve whose knife-edge contacts contact the contact ends of two wires.

FIG. 5 shows how the knife contacts 121 of two knife-edge contacts 12 contact swaged, ribbonlike knife-edge plug contacts 22. The two plug connections are separated by a dividing rib 24 that is countersunk relative to the surface of the plastic bush 20. On its side toward the contact carrier 11, the plastic bush 20 has a graduation that corresponds to the circumference of the contact carrier. As a result, the insertion opening 23 is especially reliably closed, and thus the plug connection is very securely protected against metal chips.

Figures 6, 7:
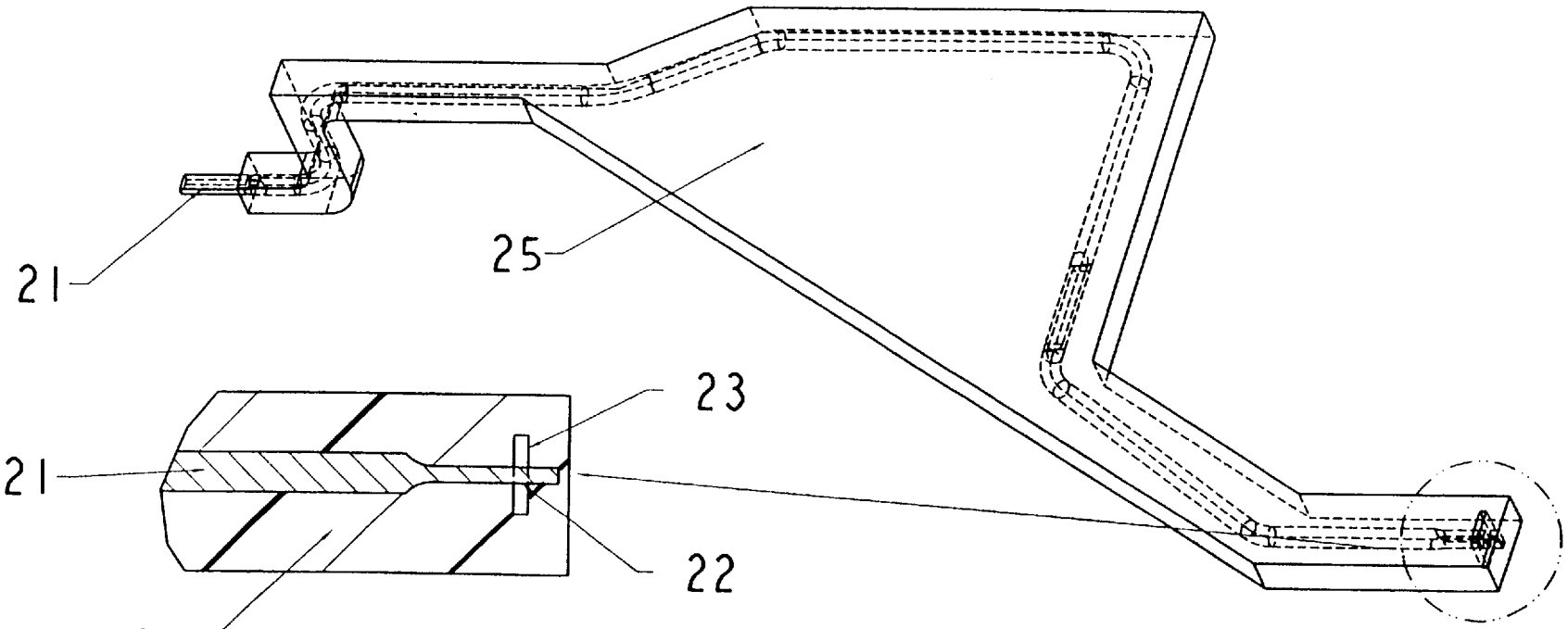
FIG. 6 is a perspective view of a carrier body with which a plastic bush is integrated.
FIG. 7 is a fragmentary sectional view, on an enlarged scale, of the plastic bush of FIG. 6.

FIG. 6 shows a portion of the support body 25. Only one wire 21 is shown. However, the support body actually holds many wires.

As indicated in FIG. 7, the wires 21 are flatened at their end portions. The slot-shaped insertion opening 23 is disposed in a plastic bush 20 in the region of the knife-edge plug contact 22 in such a way that the knife-edge plug contact is entirely surrounded by plastic upstream and downstream of the insertion opening. As a result, the contact region of the knife-edge plug contact is very reliably fixed. In the region of the insertion opening, conversely, the contact faces of the knife-edge plug contact 22 are in the open. The wire 21 or conductor can be provided with further plastic bushes 20 and knife-edge plug contacts or contact ends in order to make parallel electrical connections.

We claim:

1. In combination with a magnet valve of a motor vehicle transmission and an electronic control unit, an electrical plug connection connecting the magnet valve to the electronic control unit, the electrical plug connection comprising:

a contact carrier formed onto the magnet valve, and a knife-edge contact supported by said contact carrier, said knife-edge contact having knife contacts defining a plane;

a plastic bush having an insertion opening formed therein adapted to receive said knife contacts of said knife-edge contact; and a conductor leading from said plastic bush to the electronic control unit, said conductor having a contact end oriented perpendicularly to the plane defined by said knife contacts, said contact end being embedded in said plastic bush, extending into and exposed in said insertion opening, wherein said knife-edge contact protrudes into said insertion opening and is slipped over said conductor.

2. The electrical plug connection according to claim 1, wherein said contact carrier covers said insertion opening of said plastic bush.

3. The electrical plug connection according to claim 1, wherein said contact end is integrally formed with said conductor.

4. The electrical plug connection according to claim 1, wherein said contact end is embedded in said plastic bush on opposing sides of said insertion opening.

5. The electrical plug connection according to claim 1, wherein said contact end of said conductor extends parallel to a plane of said conductor.

6. The electrical plug connection according to claim 5, wherein said contact end of said conductor extends in a plane of said conductor.

* * * * *